US006489874B2

(12) United States Patent
Katsura et al.

(10) Patent No.: US 6,489,874 B2
(45) Date of Patent: Dec. 3, 2002

(54) NON-CONTACT ELECTRIC POWER TRANSMISSION APPARATUS

(75) Inventors: Yoshinori Katsura, Hikone (JP); Mikihiro Yamashita, Echi-gun (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/911,471

(22) Filed: Jul. 25, 2001

(65) Prior Publication Data

US 2002/0057161 A1 May 16, 2002

(30) Foreign Application Priority Data

Jul. 25, 2000 (JP) ..... 2000-223524

(51) Int. Cl.[7] ..... H01F 21/06

(52) U.S. Cl. ..... 336/130; 336/118; 336/120; 336/123; 310/114

(58) Field of Search ..... 336/130–135, 336/212, 115–128, 83; 310/114, 112, 184, 115, 116

(56) References Cited

U.S. PATENT DOCUMENTS 4,321,572 A * 3/1982 Studer et al. ..... 336/120
4,754,180 A * 6/1988 Kiedrowski ..... 336/120
5,896,278 A 4/1999 Tamura et al.

FOREIGN PATENT DOCUMENTS

JP 10-215530 8/1998
JP 11-354348 12/1999

* cited by examiner

*Primary Examiner*—Lincoln Donovan
*Assistant Examiner*—Tuyen T. Nguyen
(74) *Attorney, Agent, or Firm*—Oblon, Spivak, McClelland, Maier & Neustadt, P.C.

(57) ABSTRACT

A non-contact electric power transmission apparatus including a primary unit and a secondary unit. The primary unit includes a primary core and a power primary winding. A signal secondary winding is wound around the primary core and provided to be apart from the power primary winding to form a primary gap between the power primary winding and the signal secondary winding. The secondary unit includes a secondary core and a power secondary winding. A signal primary winding is wound around the secondary core and provided to be apart from the power secondary winding to form a secondary gap between the power secondary winding and the signal primary winding.

18 Claims, 13 Drawing Sheets

NON-CONTACT ELECTRIC POWER TRANSMISSION APPARATUS

CROSS-REFERENCE TO RELATED APPLICATIONS

The present application claims priority under 35 U.S.C. 119 to Japanese Patent Application No. 2000-223524, filed Jul. 25, 2000, entitled "Non-contact Charging Trance and Method for Manufacturing Chargeable Electric Appliance Set." The contents of that application are incorporated herein by reference in their entirety.

BACKGROUND OF THE INVENTION

1. Field of the Invention

The present invention relates to a non-contact electric power transmission apparatus and an electric appliance which includes the non-contact electric power transmission apparatus.

2. Description of the Background

Referring to FIG. 12, a non-contact electric power transmission apparatus (T) has a primary unit (T1) and a secondary unit (T2). A battery charger has the primary unit (T1). An electric appliance has the secondary unit (T2). When the electric appliance is placed on the battery charger, the primary unit (T1) and the secondary unit (T2) face each other. The primary unit (T1) of FIG. 12 has a primary core (C1), a power primary winding (L1), and a signal secondary winding (L3). The primary core (C1) has a U-shape. The signal secondary winding (L3) is wound around the power primary winding (L1) coiled around the primary core (C1). The secondary unit (T2) of FIG. 12 has a secondary core (C2), a power secondary winding (L2), and a signal primary winding (L4). The secondary core (C2) has a U-shape. The signal primary winding (L4) is wound around the power secondary winding (L2) coiled around the secondary core (C2). When the electric appliance is placed on the battery charger, the facing surface of the primary core (C1) and the facing surface of the secondary core (C2) face each other. Electric power and signal are transferred between the primary unit (T1) and the secondary unit (T2) through electromagnetic induction. The electric power has a frequency of 50 kHz and the control signal has a frequency of 1 MHz.

In the conventional non-contact electric power transmission apparatus (T), the leakage flux from the power primary winding (L1) affects the signal induced in the signal secondary winding (L3). Likewise, the leakage flux from the power secondary winding (L2) affects the signal supplied to the signal primary winding (L4).

SUMMARY OF THE INVENTION

According to one aspect of the present invention, a non-contact electric power transmission apparatus includes a primary unit and a secondary unit. The primary unit includes a primary core, at least one power primary winding and at least one signal secondary winding. The primary core has a first facing surface and a first winding axis substantially parallel to the first facing surface. The at least one power primary winding is wound around the first winding axis of the primary core. At least one signal secondary winding is wound around the first winding axis of the primary core and provided to be apart from the at least one power primary winding to form a primary gap between the at least one power primary winding and the at least one signal secondary winding. The secondary unit includes a secondary core, at least one power secondary winding and at least one signal primary winding. The secondary core has a second facing surface and a second winding axis substantially parallel to the second facing surface. The at least one power secondary winding is wound around the second winding axis of the secondary core. The at least one signal primary winding is wound around the second winding axis of the secondary core and provided to be apart from the at least one power secondary winding to form a secondary gap between the at least one power secondary winding and the at least one signal primary winding. The secondary unit is configured to be placed with respect to the primary unit such that the second facing surface faces the first facing surface and such that the at least one power secondary winding and the at least one signal primary winding are electromagnetically connected to the at least one power primary winding and the at least one signal secondary winding, respectively.

According to another aspect of the present invention, an electric appliance includes a primary unit and a secondary unit. The primary unit includes a primary core, at least one power primary winding and at least one signal secondary winding. The primary core has a first facing surface and a first winding axis substantially parallel to the first facing surface. The at least one power primary winding is wound around the first winding axis of the primary core. At least one signal secondary winding is wound around the first winding axis of the primary core and provided to be apart from the at least one power primary winding to form a primary gap between the at least one power primary winding and the at least one signal secondary winding. The secondary unit includes a secondary core, at least one power secondary winding and at least one signal primary winding. The secondary core has a second facing surface and a second winding axis substantially parallel to the second facing surface. The at least one power secondary winding is wound around the second winding axis of the secondary core. The at least one signal primary winding is wound around the second winding axis of the secondary core and provided to be apart from the at least one power secondary winding to form a secondary gap between the at least one power secondary winding and the at least one signal primary winding. The secondary unit is configured to be placed with respect to the primary unit such that the second facing surface faces the first facing surface and such that the at least one power secondary winding and the at least one signal primary winding are electromagnetically connected to the at least one power primary winding and the at least one signal secondary winding, respectively.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DESCRIPTION OF THE EMBODIMENTS

Figure 1:
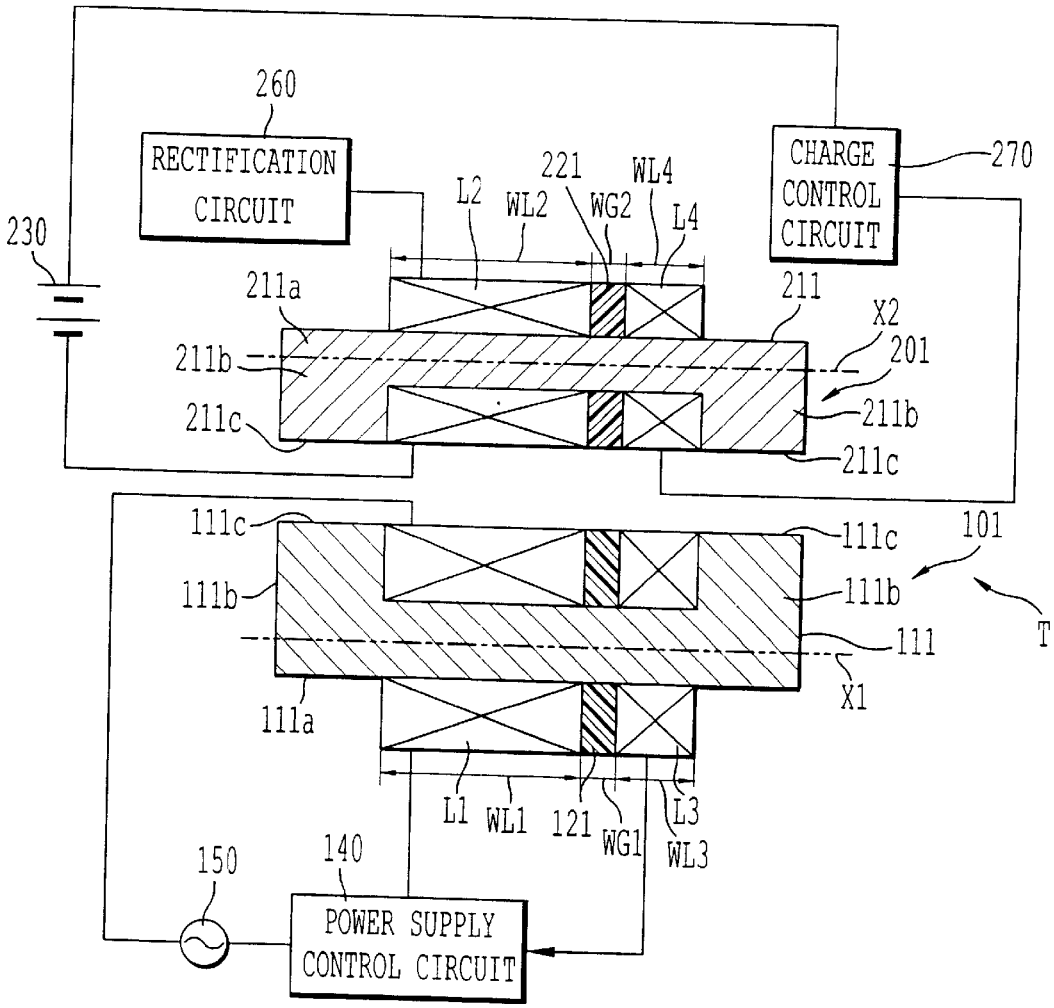
FIG. 1 is a cross sectional view of a non-contact electric power transmission apparatus according to a first embodiment of the present invention.

The embodiments will now be described with reference to the accompanying drawings, wherein like reference numerals designate corresponding or identical elements throughout the various drawings.

Figure 2:
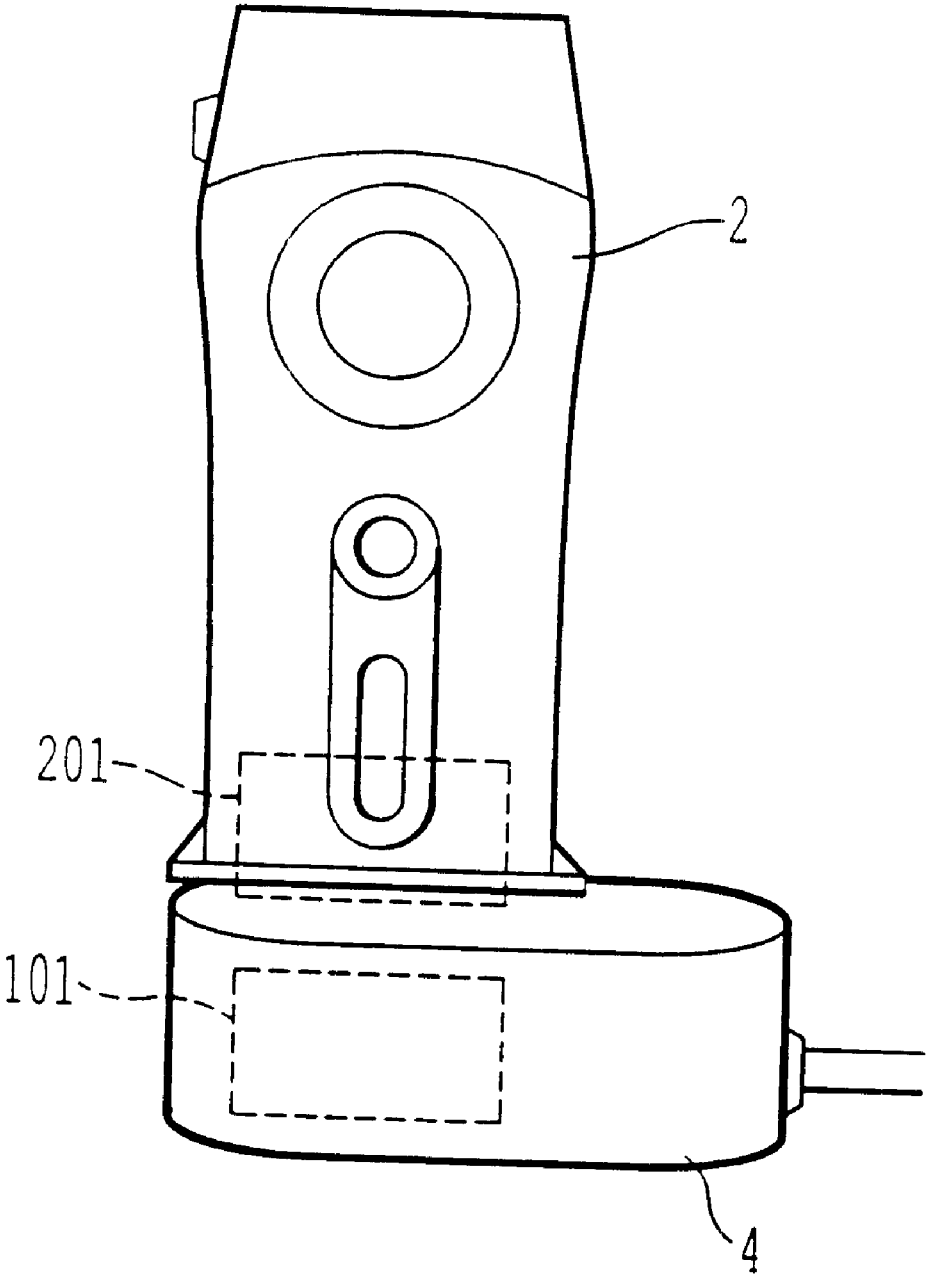
FIG. 2 is an elevational view of an electric shaver and a battery charger which include a non-contact electric power transmission apparatus according to the embodiment of the present invention.

FIG. 1 is a circuit diagram of a non-contact electric power transmission apparatus according to a first embodiment of the present invention. The non-contact electric power transmission apparatus (T) includes a primary unit 101 and a secondary unit 201. FIG. 2 illustrates a shaver 2 and a battery charger 4. The secondary unit 201 is contained in an electric appliance 2, for example, a shaver. The electric appliance 2 may be, for example, an electric toothbrush, a cellular phone or the like. A battery charger 4 has the primary unit 101. The electric appliance 2 is placed on the battery charger 4 to charge a rechargeable DC battery 230 (see FIG. 1) which is contained in the electric appliance 2.

Returning to FIG. 1, the primary unit 101 has a primary core 111. The primary core 111 has a U-shaped cross section which includes a center section (111*a*) and arm sections (111*b*) provided at both ends of the center section (111*a*), respectively. The primary core 111 has a first winding axis (X1) which is a center axis of the center section (111*a*). A power primary winding (L1) and a signal secondary winding (L3) are wound around a center section (111*a*) of the primary core 11. The signal secondary winding (L3) is provided to be apart from the power primary winding (L1) to form a primary gap 121 between the power primary winding (L1) and the signal secondary winding (L3). Each of the arm sections (111*b*) has a first facing surface (111*c*) at the ends of the arm sections (111*b*). The first winding axis (X1) of the center section (111*a*) is substantially parallel to the first facing surface (111*c*).

The power primary winding (L1) is connected to an alternating-current electric power source 150 via a power supply control circuit 140. The signal secondary winding (L3) is connected to the power supply control circuit 140. The power supply control circuit 140 is configured to control the supply of electric power to the power primary winding (L1) based on the signal from the signal secondary winding (L3).

Similarly, the secondary unit 201 has a secondary core 211. The secondary core 211 has a U-shaped cross section which includes a center section (211*a*) and arm sections (211*b*) provided at both ends of the center section (211*a*), respectively. The secondary core 211 has a second winding axis (X2) which is a center axis of the center section (211*a*). A power secondary winding (L2) and a signal primary winding (L4) are wound around the center section (211*a*) of the secondary core 211. The signal primary winding (L4) is provided to be apart from the power secondary winding (L2) to form a secondary gap 221 between the power secondary winding (L2) and the signal primary winding (L4). Each of the arm sections (211*b*) has a second facing surface (211*c*) at the ends of the arm sections (211*b*). The second winding axis (X2) of the center section (211*a*) is substantially parallel to the second facing surface (211*c*).

The power secondary winding (L2) is connected to a rechargeable DC battery 230 via a rectification circuit 260. The signal primary winding (L4) is connected to the charge control circuit 270. The charge control circuit 270 detects a charging signal from the battery circuit and sends a signal to the signal primary winding (L4).

Areas of the first facing surface (111*c*) and the second facing surface (211*c*) are substantially equal. In order to charge the rechargeable DC battery 230, the secondary unit 201 is placed with respect to the primary unit 101 such that the second facing surface (211*c*) faces the first facing surface (111*c*) and such that the power secondary winding (L2) and the signal primary winding (L4) are electromagnetically connected to the power primary winding (L1) and a signal secondary winding (L3), respectively.

When alternating-current primary electric power is supplied to the power primary winding (L1), secondary electric power is induced in the power secondary winding (L2). Namely, the power primary winding (L1) and the power secondary winding (L2) transform the primary electric power to the secondary electric power having desired voltage or current. The power supply control circuit 140 is configured to control the intermittent or continuous supply of electric power to the power primary winding (L1) based on the signal from the signal secondary winding (L3). The secondary electric power induced in the power secondary winding (L2) is supplied to the rechargeable DC battery 230 via the rectification circuit 260. The secondary electric power may be supplied to a motor or the like provided in the secondary unit.

The secondary unit has a charge control circuit 270. The charge control circuit 270 outputs the control signal which shows that the charge to the rechargeable DC battery 230 has been completed. The charge control circuit 270 includes a detector which is configured to detect the full charge condition of the rechargeable DC battery 230. The detector may be, for example, a voltage detector to detect the voltage of the rechargeable DC battery 230, a voltage inclination calculator, a temperature sensor to detect the temperature of the rechargeable DC battery 230, a temperature-gradient calculator, a timer for counting the charging time or the like. The control signal output from the detector is transmitted from the signal primary winding (L4) to the signal secondary winding (L3).

As shown in FIG. 1, at the center section (111*a*) of the primary core 111, a primary gap 121 is formed between the power primary winding (L1) and the signal secondary winding (L3). A nonmagnetic substance is filled in the primary gap 121. The power primary winding (L1) and the signal secondary winding (L3) are separated by the primary gap 121 along the first winding axis (X1). At the center section (211*a*) of the secondary core 211, a secondary gap 221 is formed between the power secondary winding (L2) and the signal primary winding (L4). A nonmagnetic substance is filled in the secondary gap 221. The power secondary winding (L2) and the signal secondary winding (L3) are separated by the secondary gap 221 along the second winding axis (X2). Both gaps 121 and 221 have the substantially same length along the first and second winding axes (X1 and X2). For example, the width (WL1) of the power primary winding (L1) along the first winding axis (X1) and the width (WL2) of the power secondary winding (L2) are about 3 mm, the width (WL3) of the signal secondary winding (L3) and the width (WL4) of the signal primary (L4) are about 1 mm, and the width (WG1) of the primary gap 121 and the width (WG2) of the secondary gap 221 are about 2 mm. Both gaps 121 and 221 are configured to face each other when the secondary unit 201 is positioned at a predetermined position with respect to the primary unit 101 to charge the battery 230. Although a nonmagnetic substance is filled in the gaps 121 and 221, these gaps 121 and 221 may be spaces filled with air.

Figure 3:
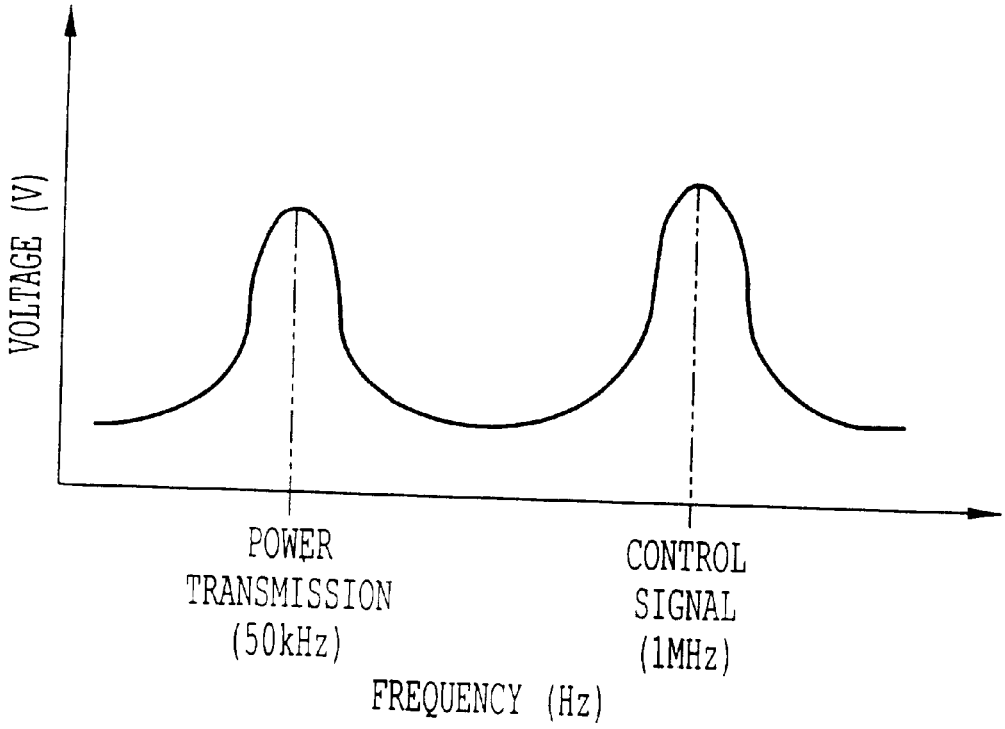
FIG. 3 is a graph showing a relationship between a frequency and voltage.

FIG. 3 illustrates a relationship between the frequency and the voltage of control signals and electric power to be transmitted. The electric power has a frequency of b 50 kHz, and the control signal has a frequency of 1 MHz. By forming the primary gap 121, the influence of leakage flux may reduce between the power primary winding (L1) and the signal secondary winding (L3). Likewise, the influence of leakage flux may reduce between the power secondary winding (L2) and the signal primary winding (L4). It is possible to transfer signal effectively using two signals whose frequencies differ mutually.

The primary gap 121 has a primary width (WG1) between the power primary winding (L1) and the signal secondary winding (L3) along the first winding axis (X1). The secondary gap 221 has a secondary width (WG2) between the power secondary winding (L2) and the signal primary winding (L4) along the second winding axis (X2). The primary and secondary widths (WG1 and WG2) are formed such that the most effectively transmitted frequency of the signal which is configured to be transmitted from the signal primary winding (L4) to the signal secondary winding (L3) is higher than a frequency of electric power which is configured to be transmitted from the power primary winding (L1) to the power secondary winding (L2). For example, the signal has a frequency of 1 MHz, and the electric power has a frequency of 50 KHz.

The frequency of the electric power which is most effectively transmitted between the power primary winding (L1) and the power secondary winding (L2) is determined based on the number of turns of the power primary winding (L1) and the number of turns of the power secondary winding (L2). The frequency of the signal which is most effectively transmitted between the signal secondary winding (L3) and the signal primary winding (L4) is determined based on the number of turns of the signal secondary winding (L3) and the number of turns of the signal primary winding (L4).

In addition, the frequency of the electric power which is most effectively transmitted between the power primary winding (L1) and the power secondary winding (L2) is determined based on the diameters of wires which constitute the power primary winding (L1) and the power secondary winding (L2). The frequency of the signal which is most effectively transmitted between the signal secondary winding (L3) and the signal primary winding (L4) is determined based on the diameters of wires which constitute the signal secondary winding (L3) and the signal primary winding (L4).

When an electric appliance including different secondary unit which has the different most effectively transmitted frequency band is incorrectly placed on the battery charger including the primary unit 101, the control signal is not transmitted to the signal secondary winding effectively. The power supply control circuit 140 starts to supply electric power to the power primary winding (L1) only when signal secondary winding (L3) receives control signal which has a level higher than a reference threshold level. Consequently, only when the proper electric appliance is placed on the battery charger, the charge to the electric appliance starts.

Figure 13:
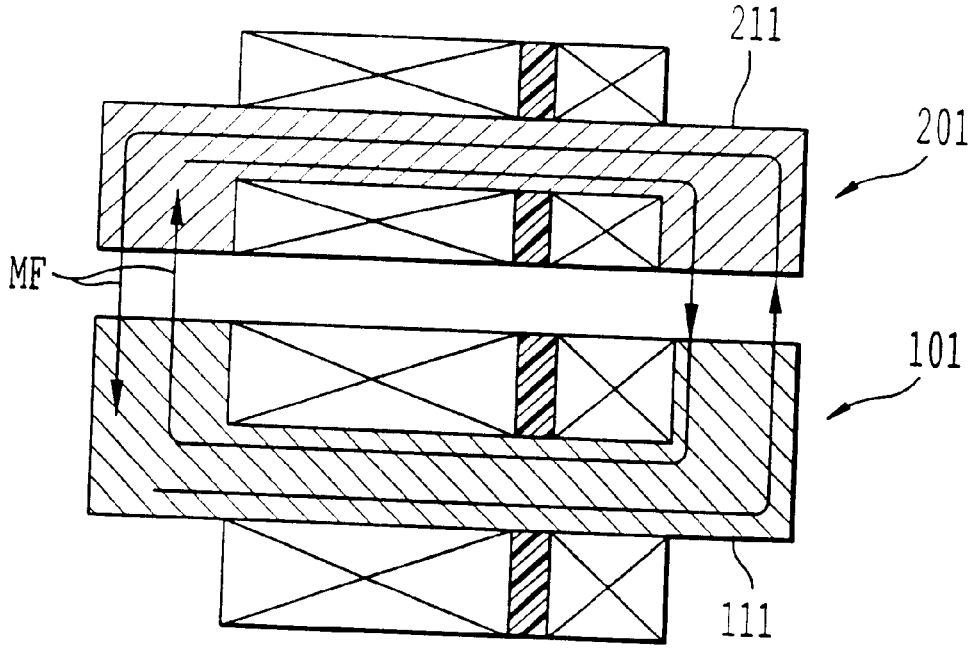
FIG. 13 is a cross sectional view of a non-contact electric power transmission apparatus according to a first embodiment of the present invention showing a direction of magnetic flux.

In the present embodiment, the power primary winding (L1) and the signal secondary winding (L3) are wound around the center section (111*a*), and the power secondary winding (L2) and the signal primary winding (L4) are wound around the center section (211*a*). Further, the secondary unit is configured to be placed with respect to the primary unit such that the second facing surface (211*c*) faces the first facing surface (111*c*). Accordingly, in the present embodiment, the direction of magnetic flux is shown by arrows (MF) in FIG. 13. Hence, leakage flux may reduce. Consequently, the electric power is efficiently transmitted from power primary winding (L1) to the power secondary winding (L2). Further, the signal is also efficiently transmitted from the signal primary winding (L4) to the signal secondary winding (L3).

By forming the primary gap 121, the influence of leakage flux may reduce between the power primary winding (L1) and the signal secondary winding (L3). Likewise, the influence of leakage flux may reduce between the power secondary winding (L2) and the signal primary winding (L4). Therefore, the signal is transmitted from the signal primary winding (L4) to the signal secondary winding (L3) without being affected by the of leakage flux. Hence, the transmission of the electric power from the power primary winding (L1) to the power secondary winding (L2) is precisely carried out based on the control signal.

Figure 4:
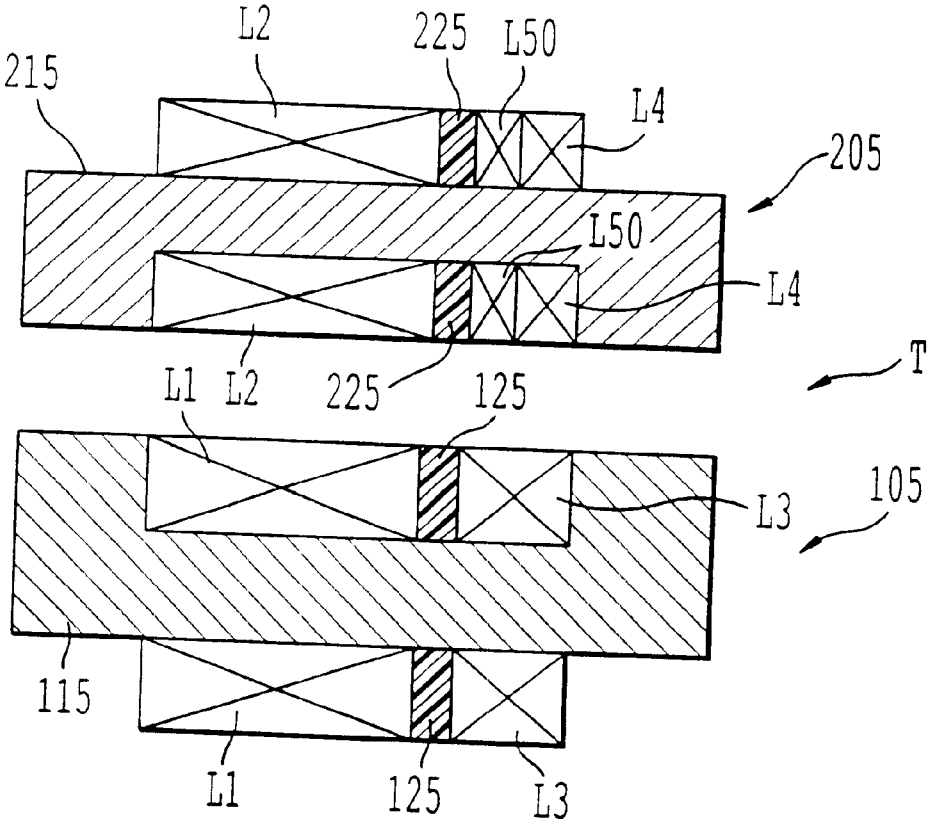
FIG. 4 is a cross sectional view of a non-contact electric power transmission apparatus according to a second embodiment of the present invention.
Figure 5:
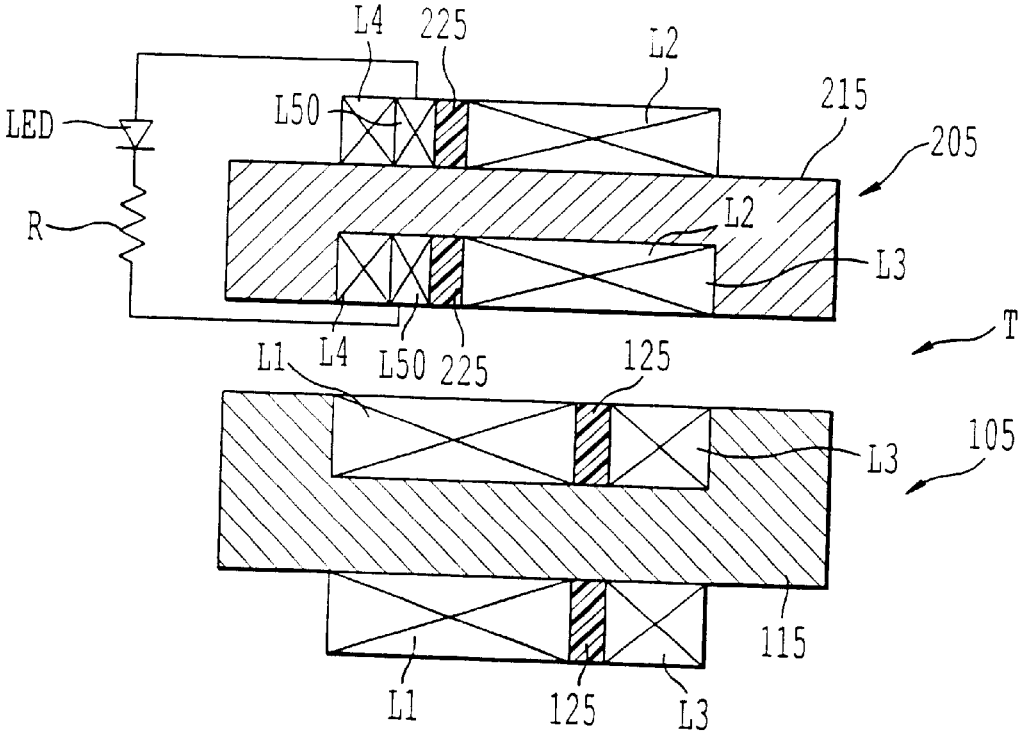
FIG. 5 is a cross sectional view of the non-contact electric power transmission apparatus according to the second embodiment of the present invention.

FIG. 4 is a cross sectional view of a non-contact electric power transmission apparatus according to a second embodiment of the present invention. The non-contact electric power transmission apparatus shown in FIG. 4 further includes a detection winding (L50). The non-contact electric power transmission apparatus (T) includes a primary unit 105 and a secondary unit 205. FIG. 5 illustrates a state where the secondary unit 205 is placed in the wrong direction with respect to the primary unit 105.

As shown in FIG. 4, the secondary unit 205 has a signal primary winding (L4) and the detecting coil (L50) wound around a secondary core 215. The detecting coil (L50) is formed next to the signal primary winding (L4) to form a gap 225 between the power secondary winding (L2) and the detecting coil (L50). The primary unit 105 has a signal secondary winding (L3) which is configured to face the signal primary winding (L4) and the detection winding (L50). The gap 225 reduces the electromagnetic effect of the power primary winding (L1) to the detection winding (L50). Where the electric appliance including the secondary unit 205 is placed in the right direction with respect to the primary unit 105, electric power is not transmitted to the detection winding (L50) from the power primary winding (L1).

As shown in FIG. 5, when the electric appliance including the secondary unit 205 is put in the wrong direction with respect to the primary unit 105, the coupling coefficient of the power primary winding (L1) and the power secondary winding (L2) becomes low. Accordingly, sufficient electric power is not transferred from the power primary winding (L1) to the power secondary winding (L2). In this condition, electromagnetic connection between the power primary winding (L1) and the detection winding (L50) becomes stronger. Accordingly, electric power is transmitted to the detection winding (L50) from the power primary winding (L1). An LED as an information unit is connected to the detection winding (L50). When the electric appliance is put in the wrong direction with respect to the battery charger including the primary unit 105, electric power is induced in the detection winding (L50). Thus, the LED lights up. Consequently, when the electric appliance is put in the wrong direction with respect to the battery charger, the LED notifies a user. In FIG. 5, a resistance (R) connected to the LED in series is resistance to limit current. The information unit may be, for example, a crystalline liquid, a buzzer circuit or the like.

In addition, the frequency of the signal which is most effectively transmitted is determined based on the number of turns of the winding. Also, the frequency of the signal which is most effectively transmitted is determined based on the diameter of the wire which constitutes the winding.

Figure 6:
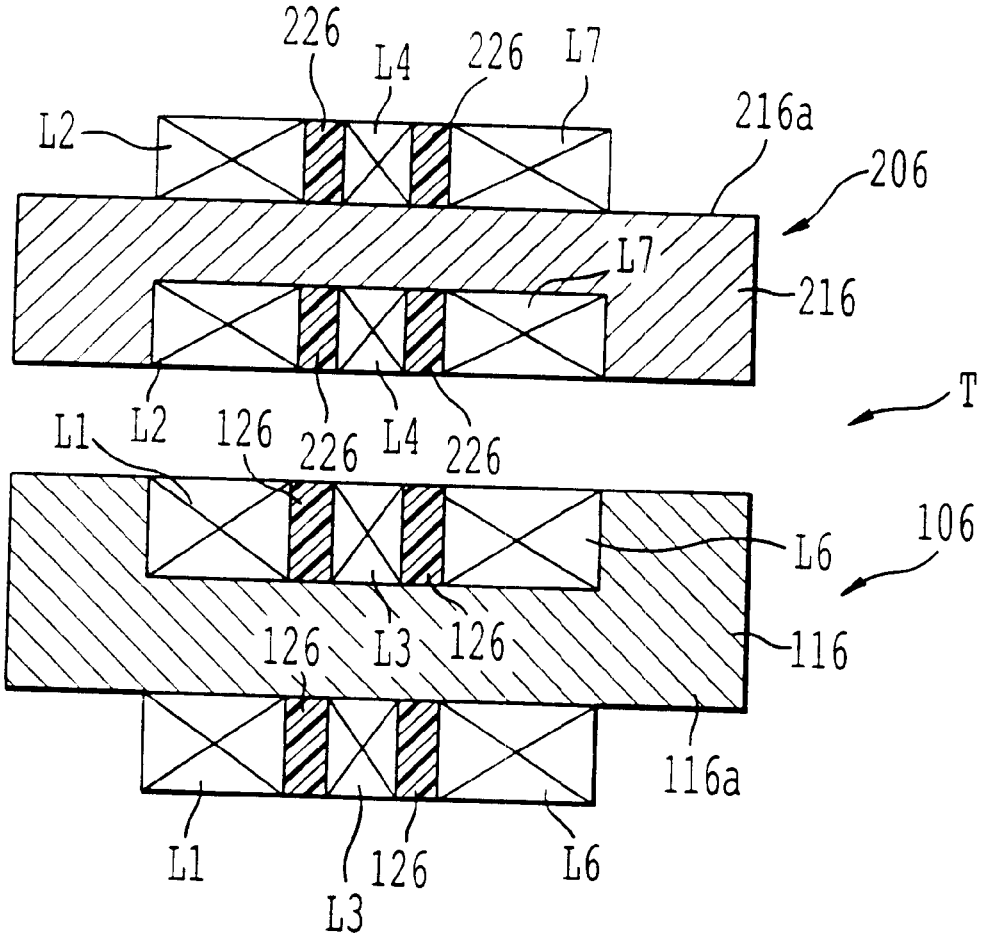
FIG. 6 is a cross sectional view of a non-contact electric power transmission apparatus according to a third embodiment of the present invention.

FIG. 6 is a cross sectional view of a non-contact electric power transmission apparatus according to a third embodiment of the present invention. The non-contact electric power transmission apparatus (T) includes a primary unit 116 and a secondary unit 216.

As shown in FIG. 6, first and second power primary windings (L1) and (L6) are wound around the both sides of the center section (116*a*) of the primary core 116 of the primary unit 106. The number of turns of power primary winding (L1) and the number of turns of power primary winding (L6) are equal or substantially equal. The signal secondary winding (L3) is wound around the center of the center section (116*a*) between the first and second power primary windings (L1) and (L6). The first and second power secondary windings (L2) and (L7) are wound around the both sides of the center section (216*a*) of the secondary core 216 of the secondary unit 206. The number of turns of the first power secondary winding (L2) and the number of turns of the second power secondary winding (L7) are equal or substantially equal. The signal primary winding (L4) is wound around the center of the center section (216*a*) between the first and second power secondary winding (L2) and (L7).

Figure 7:
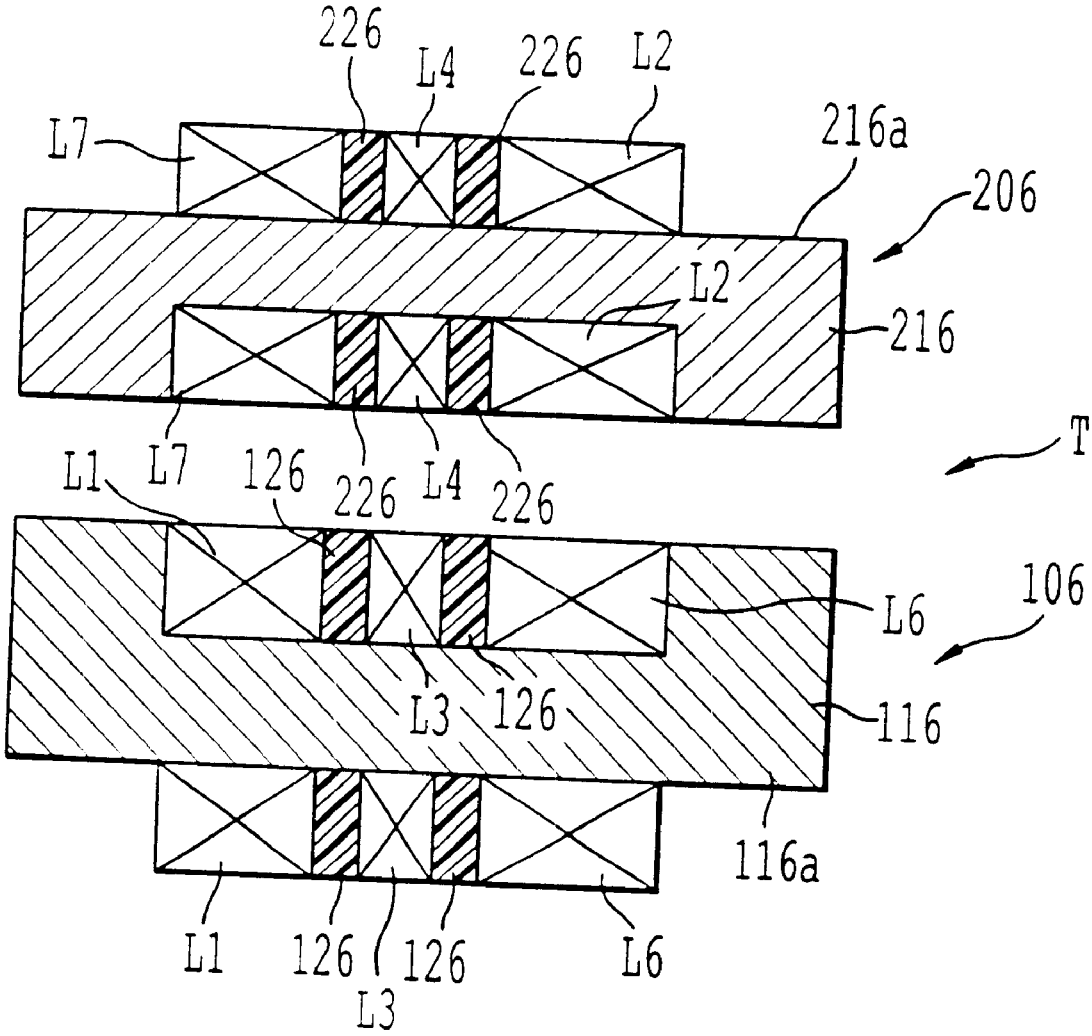
FIG. 7 is a cross sectional view of the non-contact electric power transmission apparatus according to the third embodiment of the present invention.

Electric power is transmitted to the power secondary winding (L2) from the power primary winding (L1). Electric power is also transferred from the power primary winding (L6) to the power secondary winding (L7). The total of the electric power transmitted to the power secondary winding (L2) and the power secondary winding (L7) is the total electric power transmitted to the electric appliance from the battery charger. When the electric appliance including the secondary unit 206 is put in the wrong direction with respect to the battery charger as shown in FIG. 7, electric power is transmitted from the first power primary winding (L1) to the first power secondary winding (L7). Electric power is also transferred from the second power primary winding (L6) to the second power secondary winding (L2). The number of turns of the windings, (L1) and (L6), is same or substantially same. Also, the number of turns of the power secondary winding (L2) and (L7) is same or substantially same. The electromagnetic coupling coefficient between the primary unit 106 and the secondary unit 206 does not change regardless of the mounting direction of the secondary unit 206 with respect to the primary unit 106. Therefore, users don't need to be conscious of the direction of the secondary unit 206 with respect to the primary unit 106.

In addition, the frequency of the signal which is most effectively transmitted is determined based on the number of turns of the winding. Also, the frequency of the signal which is most effectively transmitted is determined based on the diameter of the wire which constitutes the winding.

Figure 8:
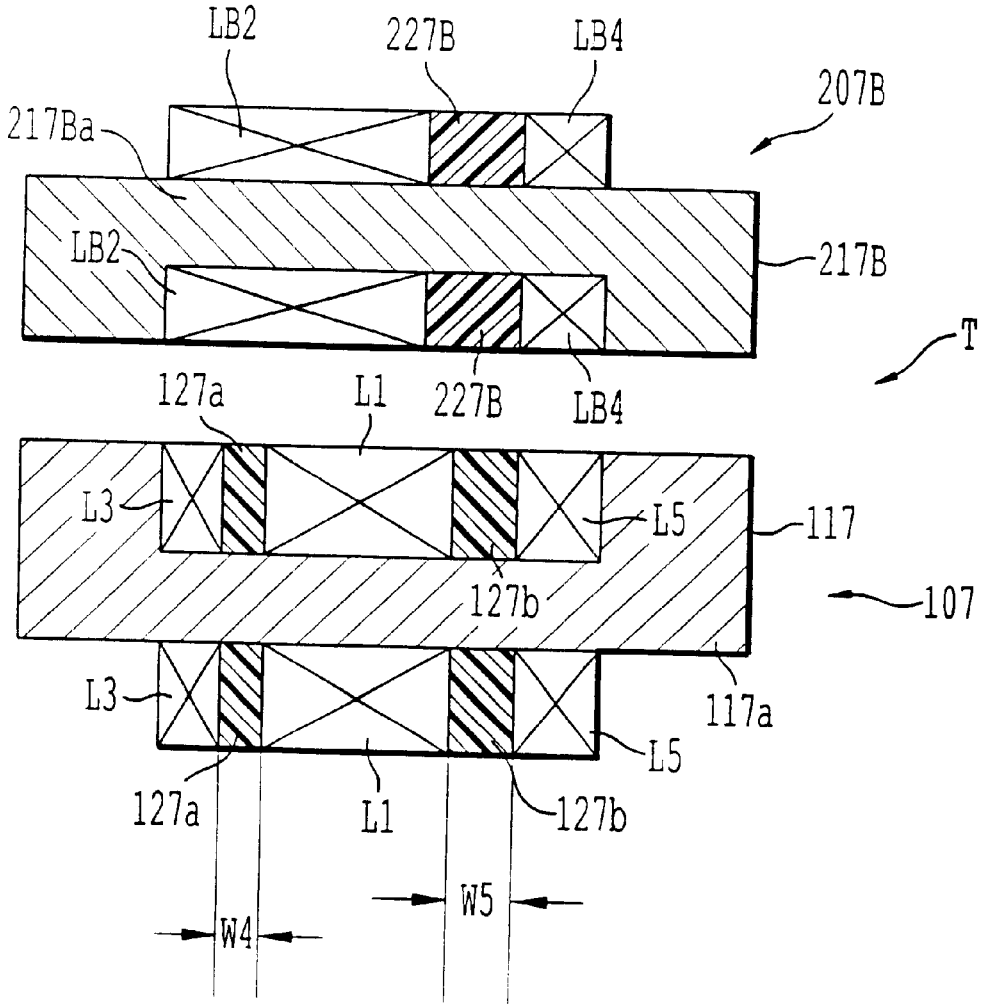
FIG. 8 is a cross sectional view of a non-contact electric power transmission apparatus according to a fourth embodiment of the present invention.

FIG. 8 is a cross sectional view of a non-contact electric power transmission apparatus according to a fourth embodiment of the present invention. The non-contact electric power transmission apparatus (T) includes a primary unit 107 and a secondary unit (207B).

Figure 9:
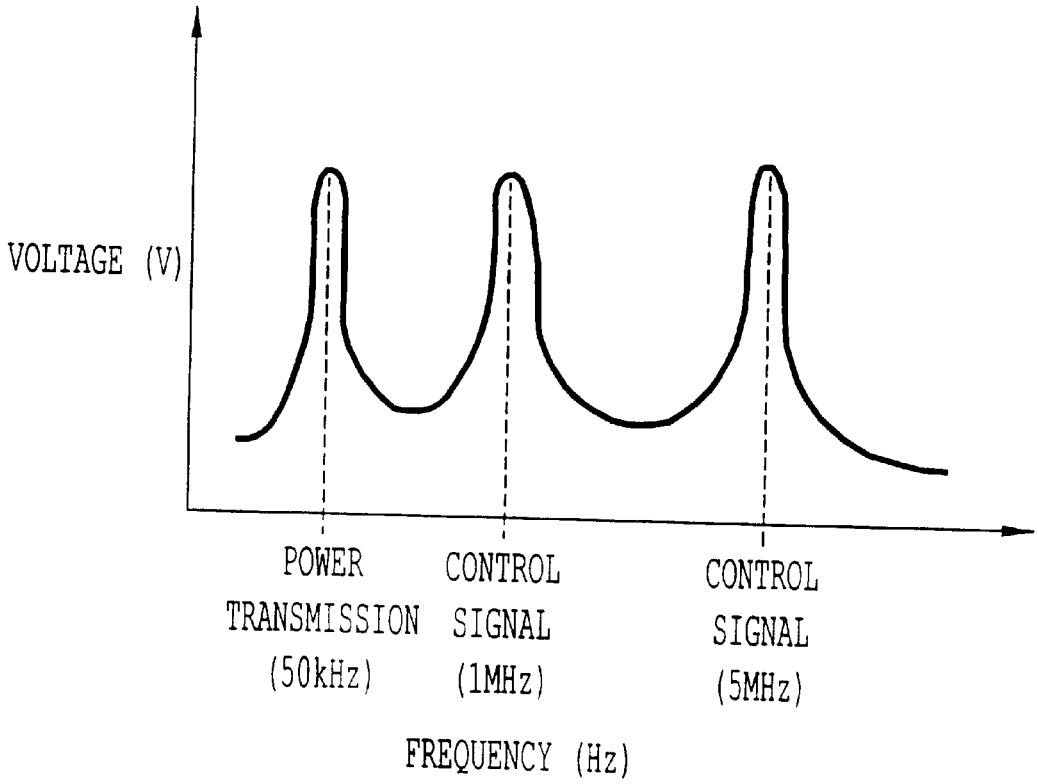
FIG. 9 is a graph showing a relationship between a frequency and voltage.

As shown in FIG. 8, the primary unit 107 has a power primary winding (L1) which is wound around the center of center section (117*a*) of the primary core 117. A first signal secondary winding (L3) is wound around one edge of the center-section (117*a*) to form a first primary gap (127*a*) between the power primary winding (L1) and the first signal secondary winding (L3). The second signal secondary winding (L5) is wound around another edge of the center-section (117*a*) to form a second primary gap (127*b*) between the power primary winding (L1) and the second signal secondary winding (L5). A width (W4) of the gap (127*a*) is narrower than a width (W5) of the gap (127*b*). Since the width (W4) of the gap (127*a*) is different from the width (W5) of the gap (127*b*), the control signal of the first signal secondary winding (L3) is adjusted to, for example, the frequency of 1 MHz, and the control signal of the second signal secondary winding (L5) is adjusted to, for example, the frequency of 5 MHz.(see FIG. 9).

Secondary core (217B) has secondary power winding (LB2) which is wound around the left side of the center section (217B*a*). A signal primary winding (LB4) is wound around the right side of the center section (217B*a*) to form a gap (227B) between the secondary power winding (LB2) and the signal primary winding (LB4). As a frequency band which is effective to transmit the signal primary winding (LB4) by adjustment of the width of the gap (227B), the signal for electric power has, for example, the frequency of 50 kHz, and the control signal has the frequency of 5 MHz.

The battery charger has a power supply control circuit 140 (see FIG. 1) having a charge control function. When the control signal with a frequency of 1 MHz is transmitted from the secondary unit, the power supply control circuit controls the primary unit 107 to output, for example, an electric power of 1.5 W. When the control signal with a frequency of 5 MHz is transmitted from the secondary unit, the power supply control circuit controls the primary unit 107 to output, for example, an electric power of 3 W. This power supply control circuit has the function to distinguish whether the frequency of the control signal transmitted from the secondary unit is 1 MHz or 5 MHz. The power supply control circuit controls output power according to the detected frequency of the control signal. The electric appliance detects by a sensor or like that if the electric appliance is set on the battery charger. For example, first, the power supply control circuit controls the primary unit 107 to output low electric power. When the electric appliance detects that an electric power is transmitted from the battery charger, the electric appliance may output a control signal. In this case, the frequency of the control signal becomes 5 MHz and thus the charge control circuit changes the power output to 3 W.

As such, one battery charger performs alternatively electric power transmission of 1.5 W and electric power transmission of 3 W. Therefore, the transformer mentioned above can transfer suitable electric power to two or more electric appliances whose load values differ.

In addition, the most effectively transmitted frequency of the control signal can also be determined based on the number of turns of the winding. Also, the most effectively transmitted frequency of the signal can be determined based on the diameter of the wire which constitutes the winding.

Figure 10:
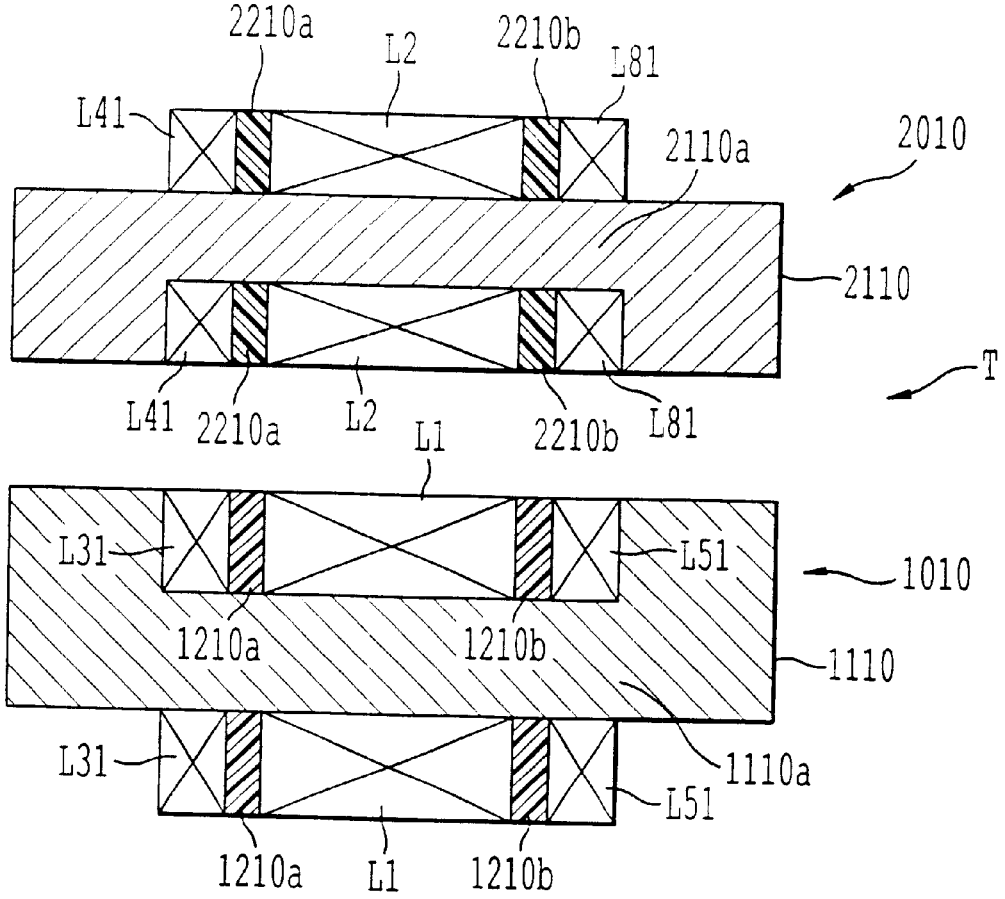
FIG. 10 is a cross sectional view of a non-contact electric power transmission apparatus according to a fifth embodiment of the present invention.
Figure 11:
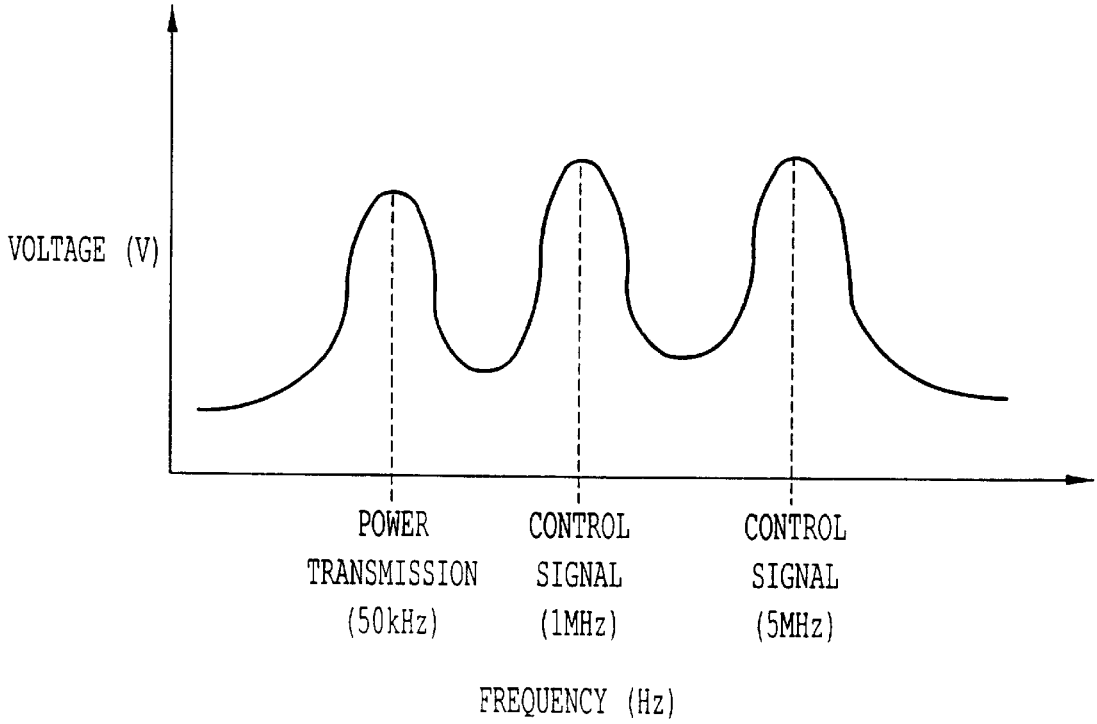
FIG. 11 is a graph showing a relationship between a frequency and voltage according to the fifth embodiment of the present invention.
Figure 12:
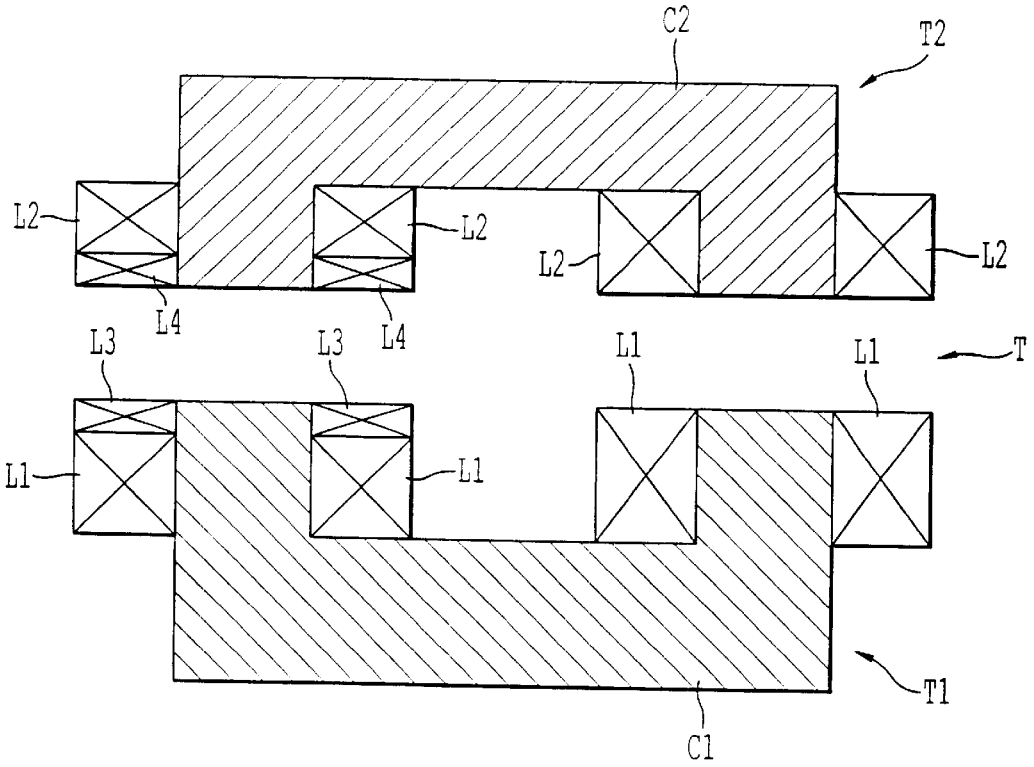
FIG. 12 PRIOR ART
FIG. 12 is a cross sectional view of a conventional non-contact electric power transmission apparatus.

FIG. 10 is a cross sectional view of a non-contact electric power transmission apparatus according to a fifth embodiment of the present invention. The non-contact electric power transmission apparatus shown in FIG. 8 is similar to that of the embodiment as shown in FIG. 1. The non-contact electric power transmission apparatus (T) includes a primary unit 1010 and a secondary unit 2010.

As shown in FIG. 10, the primary unit 1010 has a power primary winding (L1) at the center of a center section (1110*a*) of a primary core 1110. A first signal secondary winding (L31) is wound around the center section (1110*a*) at one end of the center section (1110*a*) to form a gap (1210*a*) between the power primary winding (L1) and the first signal secondary winding (L31). A second signal secondary winding (L51) is wound around the center section (1110*a*) at another end of the center section (1110*a*) to form a gap (1210*b*) between the power primary winding (L1) and the second signal secondary winding (L51). The secondary unit 2010 has a power secondary winding (L2) in the center of a center section (2110*a*) of a secondary core 2110. On both sides of a gap (2210*a*) and (2210*b*), signal primary windings (L41) and (L81) are coiled around the both sides of the power secondary winding (L2).

The non-contact electric power transmission apparatus can transfer three kinds of signals whose frequencies differ. These frequencies may be obtained, for example, by adjusting width of the gaps (1210*a*), (1210*b*), (2210*a*), and (2210*b*), by adjusting the diameters of wires which constitute the signal secondary windings (L31) and (L51), or adjusting the diameters of wires which constitute the signal primary windings (L41) and (L81) or the number of turns of the signal primary windings (L41) and (L81). The electric power signal has, for example, the frequency of 50 kHz. Between the signal secondary winding (L31), and the signal primary winding (L41), the control signal has, for example, the frequency of 1 MHz. Between the winding (L51) for secondary side control signals, and the winding (L81) for primary side control signals, the control signal has, for example, the frequency of 5 MHz. The battery charger having the primary unit 1010 is equipped with the power supply control circuit (see FIG. 1) which controls a supply of an electric power. The signal secondary winding (L31) and the signal primary winding (L41) constitute a sensor for inclination detection which detects whether the electric appliance is correctly set to the battery charger. Similarly, the signal secondary winding (L51) and the signal primary winding (L81) also constitute another sensor for inclination detection which detects whether the electric appliance is correctly set to the battery charger. Only when the signal (1 MHz and 5 MHz) is able to being detected with the winding (L41 and L81), the charge control circuit starts charging a battery 230 (see FIG. 1).

Thus, only when the control signal has been transmitted from the both sides of the winding (L41 and L81), the charge control circuit starts charging. Therefore the inadequate electric power transmission is prevented to start charging the battery when the electric appliance is inclined to the battery charger.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A non-contact electric power transmission apparatus comprising:

a primary unit comprising:

a primary core having a first facing surface and a first winding axis substantially parallel to the first facing surface;

at least one power primary winding wound around the first winding axis of the primary core; and at least one signal secondary winding wound around the first winding axis of the primary core and provided to be apart from the at least one power primary winding to form a primary gap between the at least one power primary winding and the at least one signal secondary winding; and a secondary unit comprising:

a secondary core having a second facing surface and a second winding axis substantially parallel to the second facing surface;

at least one power secondary winding wound around the second winding axis of the secondary core;

at least one signal primary winding wound around the second winding axis of the secondary core and provided to be apart from the at least one power secondary winding to form a secondary gap between the at least one power secondary winding and the at least one signal primary winding; and the secondary unit being configured to be placed with respect to the primary unit such that the second facing surface faces the first facing surface and such that said at least one power secondary winding and said at least one signal primary winding are electromagnetically connected to said at least one power primary winding and said at least one signal secondary winding, respectively.

2. A non-contact electric power transmission apparatus according to claim 1, wherein:

the primary gap has a first width between the at least one power primary winding and the at least one signal secondary winding;

the secondary gap has a second width between the at least one power secondary winding and the at least one signal primary winding; and the first and second widths are formed such that a most effectively transmitted frequency of a signal which is configured to be transmitted from the at least one signal primary winding to the at least one signal secondary winding is higher than a frequency of electric power configured to be transmitted from the at least one power primary winding to the at least one power secondary winding.

3. A non-contact electric power transmission apparatus according to claim 1, further comprising:

a detecting coil wound around the first winding axis of the primary core or the second winding axis of the secondary core and configured to detect that the at least one power secondary winding is positioned to face the at least one power primary winding along an entire length of the power secondary winding in a direction of the second winding axis.

4. A non-contact electric power transmission apparatus according to claim 3, wherein:

the detecting coil is wound around the first winding axis of the primary core and provided adjacent to the at least one signal secondary winding to be apart from the at least one power primary winding to form the primary gap between the at least one power primary winding and the at least one detecting coil.

5. A non-contact electric power transmission apparatus according to claim 1, wherein:

the at least one power primary winding comprises first and second power primary windings each having a same winding number and a same length along the first winding axis of the primary core, the at least one signal secondary winding is provided between the first and second power primary windings to form first and second primary gaps between the first power primary winding and the at least one signal secondary winding and between the second power primary winding and the at least one signal secondary winding, respectively, and the at least one secondary primary winding comprises a first and second power secondary windings each having a same winding number and a same length along the second winding axis of the secondary core, the at least one signal primary winding is provided between the first and second power secondary windings to form first and second secondary gaps between the first power secondary winding and the at least one signal primary winding and between the second power secondary winding and the at least one signal primary winding, respectively.

6. A non-contact electric power transmission apparatus according to claim 1, wherein:

the at least one signal secondary winding includes first and second signal secondary windings, the first signal secondary winding being provided on one side of the at least one power primary winding to form a first primary gap between the first signal secondary winding and the at least one power primary winding, the second signal secondary winding being provided on another side of the at least one power primary winding to form a second primary gap between the second signal secondary winding and the at least one power primary winding.

7. A non-contact electric power transmission apparatus according to claim 6, wherein the first and second primary gaps are formed to have widths such that most effectively transmitted frequencies of signals configured to be transmitted from the signal primary winding to the first and second signal secondary windings are different.

8. A non-contact electric power transmission apparatus according to claim 6, wherein the first and second signal secondary windings are formed to have different winding numbers such that most effectively transmitted frequencies of signals which are configured to be transmitted from the at least one signal primary winding to the first and second signal secondary windings are different.

9. A non-contact electric power transmission apparatus according to claim 6, wherein the first and second signal secondary windings are formed by winding wires having different diameters, respectively, such that most effectively transmitted frequencies of signals which are configured to be transmitted from the at least one signal primary winding to the first and second signal secondary windings are different.

10. A non-contact electric power transmission apparatus according to claim 1, wherein:

at least one signal primary winding includes first and second signal primary windings, the first signal primary winding being provided on one side of the at least one power secondary winding to form a first secondary gap between the first signal primary winding and the at least one power secondary winding, the second signal primary winding being provided on another side of the at least one power secondary winding to form a second secondary gap between the second signal primary winding and the at least one power secondary winding.

11. A non-contact electric power transmission apparatus according to claim 10, wherein the first and second secondary gaps are formed to have widths such that most effectively transmitted frequencies of signals which are configured to be transmitted from the first and second signal primary winding to the at least one signal secondary windings are different.

12. A non-contact electric power transmission apparatus according to claim 10, wherein the first and second signal primary windings are formed to have different winding numbers such that most effectively transmitted frequencies of signals which are configured to be transmitted from the first and second signal primary winding to the at least one signal secondary windings are different.

13. A non-contact electric power transmission apparatus according to claim 10, wherein the first and second signal primary windings are formed by winding wires having different diameters, respectively, such that most effectively transmitted frequencies of signals which are configured to be transmitted from the first and second signal primary windings to the signal secondary windings are different.

14. A non-contact electric power transmission apparatus according to claim 6, wherein:

the at least one signal primary winding includes first and second signal primary windings, the first signal primary winding being provided on one side of the at least one power secondary winding to form a first secondary gap between the first signal primary winding and the at least one power secondary winding, the second signal primary winding being provided on another side of the at least one power secondary winding to form a second secondary gap between the second signal primary winding and the at least one power secondary winding, and the first and second signal secondary windings are formed to have different winding numbers and the first and second signal primary windings are formed to have different winding numbers such that most effectively transmitted frequencies of signals which are configured to be transmitted from the at least one signal primary winding to the first and second signal secondary windings are different.

15. A non-contact electric power transmission apparatus according to claim 6, wherein:

at least one signal primary winding includes first and second signal primary windings, the first signal primary winding being provided on one side of the at least one power secondary winding to form a first secondary gap between the first signal primary winding and the at least one power secondary winding, the second signal primary winding being provided on another side of the at least one power secondary winding to form a second secondary gap between the second signal primary winding and the at least one power secondary winding, and the first and second signal secondary windings are formed by winding wires having different diameters, respectively, and the first and second signal primary windings are formed by winding wires having different diameters, respectively, such that most effectively transmitted frequencies of signals which are configured to be transmitted from the at least one signal primary winding to the first and second signal secondary windings are different.

16. A non-contact electric power transmission apparatus according to claim 1, wherein the primary and secondary gaps are filled with non-magnetic material.

17. A non-contact electric power transmission apparatus according to claim 1, wherein the primary and secondary gaps are filled with air.

18. An electric appliance comprising:

a primary unit comprising:

a primary core having a first facing surface and a first winding axis substantially parallel to the first facing surface;

at least one power primary winding wound around the first winding axis of the primary core; and at least one signal secondary winding wound around the first winding axis of the primary core and provided to be apart from the at least one power primary winding to form a primary gap between the at least one power primary winding and the at least one signal secondary winding; and a secondary unit comprising:

a secondary core having a second facing surface and a second winding axis substantially parallel to the second facing surface;

at least one power secondary winding wound around the second winding axis of the secondary core;

at least one signal primary winding wound around the second winding axis of the secondary core and provided to be apart from the at least one power secondary winding to form a secondary gap between the at least one power secondary winding and the at least one signal primary winding; and the secondary unit being configured to be placed with respect to the primary unit such that the second facing surface faces the first facing surface and such that said at least one power secondary winding and said at least one signal primary winding are electromagnetically connected to said at least one power primary winding and said at least one signal secondary winding, respectively.

* * * * *